US011396636B2

(12) United States Patent
Lee et al.

(10) Patent No.: US 11,396,636 B2
(45) Date of Patent: Jul. 26, 2022

(54) MINERAL BASE OIL HAVING IMPROVED LOW TEMPERATURE PROPERTY, METHOD FOR MANUFACTURING SAME, AND LUBRICATION OIL PRODUCT COMPRISING SAME

(71) Applicants: SK INNOVATION CO., LTD., Seoul (KR); SK LUBRICANTS CO., LTD., Seoul (KR)

(72) Inventors: Seung Eon Lee, Daejeon (KR); Hak Mook Kim, Daejeon (KR); Jin Hee Ok, Daejeon (KR); Kyung Seok Noh, Daejeon (KR); Jun Soo Park, Daejeon (KR); Yong Rae Cho, Daejeon (KR)

(73) Assignee: SK INNOVATION CO., LTD., Seoul (KR)

( * ) Notice: Subject to any disclaimer, the term of this patent is extended or adjusted under 35 U.S.C. 154(b) by 0 days.

(21) Appl. No.: 17/280,864

(22) PCT Filed: Sep. 24, 2019

(86) PCT No.: PCT/KR2019/012372
§ 371 (c)(1),
(2) Date: Mar. 26, 2021

(87) PCT Pub. No.: WO2020/067690
PCT Pub. Date: Apr. 2, 2020

(65) Prior Publication Data

US 2021/0403823 A1 Dec. 30, 2021

(30) Foreign Application Priority Data

Sep. 27, 2018 (KR) ..... 10-2018-0115158

(51) Int. Cl.
*C10M 101/02* (2006.01)
*C10N 30/00* (2006.01)
(Continued)

(52) U.S. Cl.
CPC .. *C10M 101/02* (2013.01); *C10M 2203/1006* (2013.01); *C10M 2203/1025* (2013.01);
(Continued)

(58) Field of Classification Search
CPC ..... C10M 101/02; C10M 2203/1006; C10M 2203/1025; C10M 2203/1045;
(Continued)

(56) References Cited

U.S. PATENT DOCUMENTS 4,906,350 A * 3/1990 Lucien ..... C10G 65/12 208/97
6,517,704 B1 2/2003 Carroll et al.
(Continued)

FOREIGN PATENT DOCUMENTS

JP 2004528426 A 9/2004
JP 2010254783 A 11/2010
(Continued)

OTHER PUBLICATIONS

KR10-2018-01 15158 Office Action dated Feb. 13, 2019, 14 pgs.
(Continued)

*Primary Examiner* — Ellen M McAvoy
(74) *Attorney, Agent, or Firm* — Bracewell LLP; Brad Y. Chin

(57) ABSTRACT

Proposed is a mineral lubricating base oil having improved low-temperature performance, in which the lubricating base oil has kinematic viscosity of 9.0 cSt or less (at 40° C.), kinematic viscosity of 2.5 cSt or less (at 100° C.), and a pour point of −50° C. or less.

13 Claims, 2 Drawing Sheets

(51) Int. Cl.

| | |
|---|---|
| *C10N 20/00* | (2006.01) |
| *C10N 20/02* | (2006.01) |
| *C10N 30/02* | (2006.01) |
| *C10N 40/08* | (2006.01) |
| *C10N 40/16* | (2006.01) |

(52) U.S. Cl.
CPC ..... *C10M 2203/1045* (2013.01); *C10M 2203/1065* (2013.01); *C10N 2020/015* (2020.05); *C10N 2020/02* (2013.01); *C10N 2030/02* (2013.01); *C10N 2030/74* (2020.05); *C10N 2040/08* (2013.01); *C10N 2040/16* (2013.01)

(58) Field of Classification Search
CPC ..... C10M 223/1065; C10N 2020/015; C10N 2020/02; C10N 2030/02; C10N 2030/74; C10N 2040/08; C10N 2040/16
USPC ..... 208/18
See application file for complete search history.

(56) References Cited

U.S. PATENT DOCUMENTS

| | | | | |
|---|---|---|---|---|
| 2007/0191239 | A1* | 8/2007 | Matsuoka | C10M 169/041 508/465 |
| 2008/0156691 | A1* | 7/2008 | Busatto | C10M 107/02 208/19 |
| 2011/0034358 | A1 | 2/2011 | Komatsubara | |
| 2011/0049008 | A1* | 3/2011 | Tagawa | C10G 45/58 208/18 |
| 2012/0077923 | A1* | 3/2012 | Tredget | C10M 143/00 524/476 |
| 2015/0057202 | A1* | 2/2015 | Nakao | C10M 169/041 508/469 |
| 2015/0060327 | A1* | 3/2015 | Tagawa | C10M 101/02 208/18 |
| 2015/0060328 | A1* | 3/2015 | Tagawa | C10G 67/02 208/18 |
| 2016/0040095 | A1* | 2/2016 | Fujii | C10M 169/044 508/287 |
| 2016/0042830 | A1* | 2/2016 | Ohno | C10M 101/02 252/570 |
| 2016/0194578 | A1 | 7/2016 | Sakanoue et al. | |
| 2020/0339905 | A1* | 10/2020 | Champagne | C10M 101/02 |

FOREIGN PATENT DOCUMENTS

| | | | |
|---|---|---|---|
| JP | 2013534558 | A | 9/2013 |
| KR | 10-2007-0019389 | A | 2/2007 |
| KR | 10-2011-0033978 | A | 4/2011 |
| KR | 10-2013-0001105 | A | 1/2013 |
| KR | 10-1399207 | B1 | 5/2014 |
| KR | 10-2014-0122001 | A | 10/2014 |
| KR | 10-1525036 | B1 | 6/2015 |
| KR | 10-1679426 | B1 | 11/2016 |
| KR | 10-2017-0001062 | A | 1/2017 |
| WO | 2002070629 | A1 | 9/2002 |
| WO | 200919505 | A1 | 10/2009 |
| WO | 2010077352 | A1 | 7/2010 |
| WO | 2018097173 | A1 | 5/2018 |

OTHER PUBLICATIONS

PCT/KR2019/012372 International Search Report dated Jan. 2, 2020, 2 pgs.
EP19865250.5 Extended European Search Report dated May 24, 2022, 9 pgs.

* cited by examiner

MINERAL BASE OIL HAVING IMPROVED LOW TEMPERATURE PROPERTY, METHOD FOR MANUFACTURING SAME, AND LUBRICATION OIL PRODUCT COMPRISING SAME

CROSS REFERENCE TO RELATED APPLICATIONS

This application claims priority to and the benefit of PCT/KR2019/012372, filed on Sep. 24, 2019, which claims benefit to Korean Patent Application Serial No. 10-2018-0115158, filed Sep. 27, 2018, the entire contents of which are incorporated herein for all purposes by this reference.

BACKGROUND

Field

The present disclosure relates to a mineral lubricating base oil having improved low-temperature performance, a method of manufacturing the same, and a lubricant product including the same, and more particularly to a mineral lubricating base oil having improved low-temperature performance and very low viscosity manufactured from treated liquid gas oil (t-LGO) resulting from hydrocracking, a method of manufacturing the same, and a lubricant product including the same.

Description of the Related Art

Lubricating base oil is a material for lubricant products. Generally, excellent lubricating base oil has a high viscosity index, superior stability (to oxidation, heat, UV, etc.) and low volatility. The American Petroleum Institute (API) classifies lubricating base oils depending on the quality thereof as shown in Table 1 below.

TABLE 1

| Classification | Sulfur (%) | Saturate (%) | VI (Viscosity Index) |
|---|---|---|---|
| Group I | >0.03 | <90 | 80 to 120 |
| Group II | ≤0.03 | ≥90 | 80 to 120 |
| Group III | ≤0.03 | ≥90 | 120 or more |
| Group IV | All polyalphaolefins (PAOs) | | |
| Group V | All other lubricating base oils not included in Group I, II, III, or IV | | |

In general, among mineral lubricating base oils, lubricating base oils manufactured through a solvent extraction process mainly correspond to Group I, lubricating base oils manufactured through a hydroreforming process mostly correspond to Group II, and lubricating base oils having a high viscosity index manufactured through an advanced hydrocracking process mainly correspond to Group III.

Meanwhile, there is a need for lubricant products that are useful in harsh temperatures, such as during cold weather or in polar regions. Accordingly, many attempts have been made to improve the low-temperature performance of lubricant products by introducing additives such as a pour point depressant, a viscosity modifier and the like to conventional lubricating base oil. However, excess additive content may impair the performance of the lubricant product itself, and thus, the addition thereof faces limitations. Hence, a lubricating base oil, the intrinsic low-temperature performance of which is improved, is required.

This lubricating base oil is required to have a low viscosity and a low pour point. Suitable lubricating base oils include polyalphaolefins (PAOs) and ester base oils, among synthetic base oils. PAOs have superior viscosity stability and low-temperature fluidity, and ester base oils also have superior viscosity stability. However, PAOs and ester base oils have the disadvantage of being expensive in terms of cost.

Therefore, efforts to produce a mineral lubricating base oil that has low-temperature performance equivalent or superior to those of synthetic base oils and is competitive in price with synthetic base oils have continued. Among these, the process of producing a lubricating base oil feedstock in connection with conventional fuel-oil hydrocracking (HC) uses unconverted oil (UCO), generated by hydrocracking vacuum gas oil produced in a vacuum distillation unit. Here, the oil fraction is subjected to a hydrotreating process that removes impurities such as sulfur, nitrogen, oxygen and metal components therefrom and then to a hydrocracking process, which is the main reaction process, whereby a considerable amount thereof is converted into light hydrocarbons, which are then subjected to a series of fractional distillation processes to separate a variety of decomposed oils and gases, thereby obtaining light oil products. The above reaction is designed such that the reaction conversion rate per pass is typically about 40%, and it is impossible in practice to realize 100% conversion per pass. In the last fractional distillation process, unconverted oil (UCO) is always generated, and a portion thereof is used as a material for a lubricating base oil, and the remainder thereof is recycled to the hydrocracking process.

In regard thereto, KR 10-1399207 pertains to a method of manufacturing a high-quality lubricating base oil feedstock using unconverted oil, but the above patent merely discloses a method of producing a high-quality lubricating base oil from unconverted oil by feeding a portion of the unconverted oil to the second hydrocracking unit and recycling the same, but does not disclose the use of treated liquid gas oil resulting from hydrocracking as a feedstock for producing a lubricating base oil.

In addition, KR 10-1679426 pertains to a method of manufacturing a high-quality lubricating base oil using unconverted oil, and the above patent merely discloses the production of a lubricating base oil using two or more types of unconverted oil but does not disclose the production of a lubricating base oil using, as a feedstock, material other than unconverted oil.

As described above, there remains a need for a novel mineral lubricating base oil having price competitiveness with synthetic base oils and low-temperature performance equivalent or superior thereto.

SUMMARY

Therefore, a first embodiment of the present disclosure provides a mineral lubricating base oil having improved low-temperature performance capable of replacing the expensive synthetic base oil as described above.

A second embodiment of the present disclosure provides a lubricant product including the lubricating base oil according to the first aspect.

According to a first embodiment of the present disclosure, there is provided a mineral lubricating base oil having improved low-temperature performance has kinematic viscosity of 9.0 cSt or less (at 40° C.), kinematic viscosity of 2.5 cSt or less (at 100° C.), and a pour point of −50° C. or less.

According to an embodiment, the lubricating base oil may be derived from a feedstock including treated liquid gas oil resulting from hydrocracking, and the treated liquid gas oil may have a 10% outflow temperature of 250° C. or less and a 50% outflow temperature of 350° C. or less in a simulated distillation test according to ASTM D2887.

According to an embodiment, the treated liquid gas oil may have a specific gravity of 0.81 to 0.87, kinematic viscosity of 5.0 cSt or less (at 40° C.), kinematic viscosity of 2.0 cSt or less (at 100° C.), and a pour point of 5° C. or less, and may contain 2.0 wt % or less of each of sulfur and nitrogen.

According to an embodiment, the feedstock may include 90 wt % or more of the treated liquid gas oil.

According to an embodiment, the average carbon number of the hydrocarbon molecule in the lubricating base oil may be 14 to 25.

According to an embodiment, the amount of the hydrocarbon having 13 or fewer carbon atoms in the lubricating base oil may be 25 wt % or less based on the total weight of the lubricating base oil.

According to an embodiment, the lubricating base oil may include 10 to 50 wt % of a naphthenic hydrocarbon.

According to an embodiment, the lubricating base oil may satisfy $0.3 \leq (C_N+C_A)/C_P \leq 0.7$, in which $C_N$ is the wt % of the naphthenic hydrocarbon, $C_A$ is the wt % of the aromatic hydrocarbon, and $C_P$ is the wt % of the paraffinic hydrocarbon.

According to an embodiment, the lubricating base oil satisfies $25\% \leq C_N+C_A \leq 45\%$, in which $C_N$ is the wt % of the naphthenic hydrocarbon and $C_A$ is the wt % of the aromatic hydrocarbon.

According to an embodiment, the lubricating base oil may have kinematic viscosity of 500 cSt or less (at −40° C.).

According to an embodiment, the lubricating base oil may have a flash point of 110° C. or more, evaporation loss at 150° C. of 20 wt % or less, and a 5% outflow temperature of 200° C. or more in a simulated distillation test according to ASTM D2887.

According to a second embodiment, there is provided a lubricant product, which includes 20 to 99 wt % of the lubricating base oil according to the first embodiment and has a pour point of −40° C. or less.

According to an embodiment, the lubricant product may not include synthetic base oil.

According to an embodiment, the lubricant product may not include polyalphaolefin (PAO) or ester base oil.

According to an embodiment, there is provided a lubricating base oil has a low viscosity and pour point compared to conventional low-viscosity lubricating base oil, and thus exhibits improved low-temperature performance. The lubricating base oil can be applied to lubricant products having high performance at ultra-low viscosity or to lubricant products used in extremely cold regions, in which low-temperature performance is considered important. Moreover, it is possible to manufacture a lubricant product that satisfies the required performance through appropriate mixing with typical mineral lubricating base oil.

Conventional methods of manufacturing the lubricant products are capable of satisfying the required performance using expensive synthetic base oil such as PAO or ester base oil, but it is possible to replace the synthetic base oil with the lubricating base oil according to the present disclosure, thus generating economic benefits.

The objectives, specific advantages and novel features of the present disclosure will become more apparent from the following detailed description and preferred embodiments associated with the accompanying drawings, but the present disclosure is not necessarily limited thereto. Furthermore, in the description of the present disclosure, it is to be noted that, when known techniques related to the present disclosure may make the gist of the present disclosure unclear, a detailed description thereof will be omitted.

As used herein, the term "unconverted oil (UCO)" means unreacted oil that has been fed to a hydrocracking unit for manufacturing fuel oil but has not undergone a hydrocracking reaction.

As also used herein, the term "treated liquid gas oil (t-LGO)" means a liquid gas oil separated through fractional distillation after a hydrocracking process.

Lubricating Base Oil

An embodiment of the present disclosure provides a mineral lubricating base oil having low kinematic viscosity, a low pour point, and improved low-temperature performance, derived from a feedstock including treated liquid gas oil (t-LGO).

The treated liquid gas oil (t-LGO) according to an embodiment is derived from a product of a hydrocracking process for manufacturing fuel oil, and the treated liquid gas oil (t-LGO) may be introduced to a catalytic dewaxing (CDW) unit before or after obtaining the same. Specifically, according to an embodiment of the present disclosure, the fractionally distilled treated liquid gas oil (t-LGO), among the products of the hydrocracking process, may be subjected to a catalytic dewaxing process, and a lubricating base oil having desired properties may be separated and recovered from the product of the catalytic dewaxing process. According to another embodiment of the present disclosure, some of the products of the hydrocracking process may be fed to a catalytic dewaxing unit, and among the products of the catalytic dewaxing process, oil having the properties of the treated liquid gas oil (t-LGO) may be separated and recovered, and may be applied as a lubricating base oil.

Figure 1:
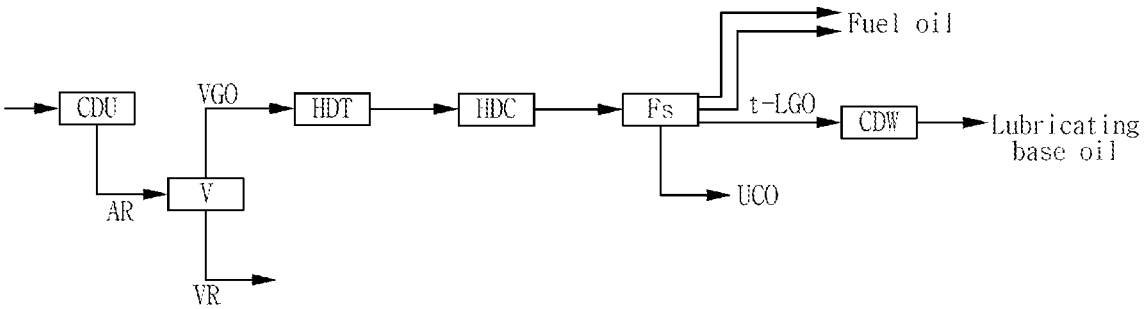
FIG. 1 schematically shows a process of manufacturing a lubricating base oil using treated liquid gas oil (t-LGO) resulting from hydrocracking according to an embodiment.

For better understanding, FIG. 1 schematically shows the process of manufacturing a lubricating base oil using treated liquid gas oil (t-LGO) resulting from hydrocracking according to an embodiment of the present disclosure. FIG. 1 schematically shows the process of manufacturing a mineral lubricating base oil using treated liquid gas oil (t-LGO) in a fuel-oil hydrogenation process using vacuum gas oil (VGO) as a feed, according to an embodiment of the present disclosure. With reference to FIG. 1, in an embodiment of the present disclosure, atmospheric residue (AR), separated from a crude distillation unit (CDU), is distilled in a vacuum distillation (V) unit and separated into vacuum gas oil (VGO) and vacuum residue (VR), and the vacuum gas oil (VGO) is sequentially fed to a hydrotreating (HDT) unit and a hydrocracking (HDC) unit. The vacuum gas oil (VGO) passed through the hydrocracking (HDC) unit is then fed to fractionators (Fs), and the treated liquid gas oil (t-LGO) is separated through the fractionators (Fs). The treated liquid gas oil (t-LGO) is fed to a catalytic dewaxing (CDW) unit, and the lubricating base oil of the present disclosure is recovered from the product of the catalytic dewaxing.

Hydrotreating (HDT) is a process for removing impurities such as sulfur, nitrogen, oxygen, and metal components contained in petroleum fractions such as vacuum gas oil (VGO). After the hydrotreating (HDT) process, the petroleum fractions are converted into light hydrocarbons through hydrocracking in a hydrocracking (HDC) unit. The hydrotreating (HDT) and hydrocracking (HDC) processes may be performed under any typical processing conditions, so long as they do not interfere with acquisition of the treated liquid gas oil (t-LGO) used in the present disclosure.

In an embodiment of the present disclosure, the treated liquid gas oil (t-LGO) may have a 10% outflow temperature of 250° C. or less and a 50% outflow temperature of 350° C. or less in a simulated distillation test according to ASTM D2887, preferably a 10% outflow temperature of 240° C. or less and a 50% outflow temperature of 340° C. or less, and more preferably a 10% outflow temperature of 230° C. or less and a 50% outflow temperature of 330° C. or less. ASTM D2887 is a method of analyzing the boiling point of a sample through a simulated gas chromatography distillation test, in which, when the temperature of the treated liquid gas oil (t-LGO) is gradually increased, the hydrocarbon components in t-LGO are eluted through a capillary column, and the boiling point distribution may be determined through comparison with a reference material measured under the same conditions. When the outflow temperature falls out of the corresponding range, the kinematic viscosity and low-temperature viscosity of the resulting base oil product may increase, which may adversely affect lubricant performance.

Also, the treated liquid gas oil (t-LGO) may have a specific gravity of 0.81 to 0.87, and preferably 0.82 to 0.86. Although the specific gravity does not directly affect the performance of the lubricating base oil, it is helpful for determining whether foreign matter is mixed in the treated liquid gas oil (t-LGO).

Also, the treated liquid gas oil (t-LGO) may have kinematic viscosity at 40° C. of 5.0 cSt or less, preferably 4.7 cSt or less, and more preferably 4.5 cSt or less, and kinematic viscosity at 100° C. of 2.0 cSt or less, preferably 1.8 cSt or less, and more preferably 1.6 cSt or less. The kinematic viscosity is a value obtained by dividing the viscosity of a fluid by the density of the fluid. In general, the "viscosity" of the lubricating base oil refers to kinematic viscosity, and the measurement temperatures thereof are set to 40° C. and 100° C. according to the viscosity classification based on the International Organization for Standardization (ISO).

Also, the treated liquid gas oil (t-LGO) may have a pour point of 5° C. or less, preferably −5° C. or less, more preferably −10° C. or less, and most preferably −15° C. or less. When the oil is cooled, the viscosity gradually increases, losing fluidity and starting to harden. The temperature at this time is called the solidification point, and the pour point is the lowest temperature at which fluidity is observed before reaching the solidification point. "Pour point" usually refers to a temperature 2.5° C. higher than the solidification point.

Also, the treated liquid gas oil (t-LGO) may contain 2.0 wt % or less of each of sulfur and nitrogen, and preferably, the treated liquid gas oil (t-LGO) contains 1.0 wt % or less of each of sulfur and nitrogen. Sulfur and nitrogen, even when present in trace amounts, may adversely affect the catalyst in subsequent processes and the stability of the final product, and are typically removed through the hydrotreating (HDT) process as described above.

According to an embodiment of the present disclosure, the feedstock may include treated liquid gas oil (t-LGO) in an amount of 90% or more, and preferably 95% or more. Most preferably, the feedstock may be composed of 100% of the treated liquid gas oil (t-LGO). If the amount of the treated liquid gas oil (t-LGO) in the feedstock is less than 90%, it is difficult to obtain a lubricating base oil imparted with improved low-temperature performance according to the present disclosure.

As described above, the treated liquid gas oil (t-LGO) in the present disclosure is fed to a catalytic dewaxing (CDW) unit before or after obtaining the same. Here, catalytic dewaxing (CDW) is a process of reducing or removing N-paraffin, which deteriorates low-temperature properties, through isomerization or cracking reactions. Therefore, catalytic dewaxing makes it possible to realize superior low-temperature properties, thus desirably satisfying the pour point requirement of the lubricating base oil. According to an embodiment of the present disclosure, the catalytic dewaxing (CDW) process may be performed under conditions of a reaction temperature of 250 to 410° C., a reaction pressure of 30 to 200 kg/cm$^2$, a liquid hourly space velocity (LHSV) of 0.1 to 3.0 hr$^{-1}$, and a hydrogen-to-feedstock volume ratio of 150 to 1000 Nm$^3$/m$^3$.

The catalyst usable in the catalytic dewaxing process may include a carrier having an acid site selected from among a molecular sieve, alumina, and silica-alumina, and at least one metal having a hydrogenation function selected from among elements of Groups 2, 6, 9 and 10 on the periodic table. In particular, among Group 9 and 10 (i.e. Group VIII) metals, Co, Ni, Pt and Pd are preferably used, and among Group 6 (i.e. Group VIB) metals, Mo and W are preferably used. Examples of the carrier having an acid site may include a molecular sieve, alumina, silica-alumina, and the like. Here, the molecular sieve may be crystalline aluminosilicate (zeolite), SAPO, or ALPO, and examples of a medium-pore molecular sieve having a 10-membered oxygen ring may include SAPO-11, SAPO-41, ZSM-11, ZSM-22, ZSM-23, ZSM-35, ZSM-48, etc., and a large-pore molecular sieve having a 12-membered oxygen ring may be used.

In the present disclosure, the dewaxed oil fraction is further introduced to a hydrofinishing (HDF) unit in the presence of a hydrofinishing catalyst. Hydrofinishing (HDF) is a process of removing olefins and polycyclic aromatics from the dewaxed oil fraction in accordance with product-specific requirements in the presence of a hydrofinishing catalyst to thereby attain stability. In particular, from the viewpoint of production of naphthenic lubricating base oil, it is a process for final control of aromatic content and gas hygroscopicity. According to an embodiment of the present disclosure, the hydrofinishing (HDF) process may be performed under conditions of a temperature of 150 to 300° C., a pressure of 30 to 200 kg/cm$^2$, an LHSV of 0.1 to 3 hr$^{-1}$, and a hydrogen-to-oil volume ratio of 300 to 1500 Nm$^3$/m$^3$.

Also, the catalyst for the hydrofinishing process is used in a form in which a metal is supported on a carrier, and the metal includes at least one metal selected from among Group 6, 8, 9, 10, and 11 elements having a hydrogenation function. It is preferred that a metal sulfide series of Ni—Mo, Co—Mo or Ni—W or a noble metal such as Pt or Pd be used. Moreover, as the carrier of the catalyst for the hydrofinishing process, silica, alumina, silica-alumina, titania, zirconia, or zeolite, having a large surface area, may be used, and preferably, alumina or silica-alumina is used.

Meanwhile, the lubricating base oil of the present disclosure manufactured from the feedstock including the treated liquid gas oil (t-LGO) may have kinematic viscosity at 40° C. of 9.0 cSt or less, preferably 8.0 cSt or less, and more preferably 7.0 cSt or less. The lubricating base oil may have kinematic viscosity at 100° C. of 2.5 cSt or less, preferably 2.3 cSt or less, and more preferably 2.0 cSt or less. Also, the lubricating base oil may have a pour point of −50° C. or less, and preferably −60° C. or less. Regarding the low-temperature performance of the lubricating base oil, the kinematic viscosity and pour point are properties that are typically used to judge low-temperature performance. The viscosity required of the lubricating base oil may differ depending on the purpose of the lubricating base oil, but the kinematic viscosity of the fluid increases with a decrease in temperature, and thus, in the present disclosure, for the purpose of improving low-temperature performance, the lower the kinematic viscosity of the lubricating base oil, the better the low-temperature performance. Moreover, the lower the pour point of the lubricating base oil, the more applicable it is to low-temperature environments. The lubricating base oil according to the present disclosure has the advantage of being applicable to lubricant products that require superior low-temperature performance or are to be used in polar regions.

According to an embodiment of the present disclosure, the lubricating base oil may have an average carbon number of 14 to 25, preferably 14 to 22, and more preferably 14 to 20 per hydrocarbon molecule in the lubricating base oil. If the average number of carbon atoms is less than 14, a problem may occur in which the flash point and evaporation loss are too low. On the other hand, if the average number of carbon atoms exceeds 25, low-temperature performance deteriorates (low-temperature viscosity and pour point become too high), which may cause a problem in which it is difficult to meet the performance requirements of the lubricant itself.

According to an embodiment of the present disclosure, the amount of a hydrocarbon molecule having 13 or fewer carbon atoms in the lubricating base oil may be 25 wt % or less, preferably 22 wt % or less, and more preferably 20 wt % or less, based on the total weight of the lubricating base oil. If the amount of the hydrocarbon molecule having 13 or fewer carbon atoms in the lubricating base oil is greater than 25 wt % based on the total weight of the lubricating base oil, the flash point may decrease, and thus high-temperature stability may be deteriorated, and moreover, evaporation loss may increase, which may shorten the lubricant replacement cycle.

According to an embodiment of the present disclosure, the lubricating base oil may include a naphthenic hydrocarbon in an amount of 10 to 50 wt %, preferably 15 to 50 wt %, and more preferably 20 to 50 wt %. If the amount of the naphthenic hydrocarbon is less than 10 wt %, the aniline point may increase, so compatibility with additives may decrease when manufacturing lubricant products, and the flash point may decrease. On the other hand, if the amount of the naphthenic hydrocarbon exceeds 50 wt %, oxidation stability and thermal stability may decrease.

As for the lubricating base oil of the present disclosure, the amount of each type of hydrocarbon in the lubricating base oil has a major effect on the properties of the lubricating base oil. More specifically, when the amount of the paraffinic hydrocarbon in the lubricating base oil increases, lubrication performance may increase, oxidation stability and thermal stability may be improved, and the ability to maintain viscosity despite changes in temperature is improved, but flowability at low temperatures is decreased. Also, when the amount of the aromatic hydrocarbon in the lubricating base oil increases, compatibility with additives may be improved, but oxidation stability and thermal stability may be deteriorated and hazardousness may increase. Also, when the amount of the naphthenic hydrocarbon in the lubricating base oil increases, compatibility with additives and flowability at low temperatures may be improved, but oxidation stability and thermal stability may be deteriorated. Meanwhile, in the present disclosure, the amount of each type of hydrocarbon in the lubricating base oil is measured through the composition analysis method specified in ASTM D2140 or ASTM 3238.

The inventors of the present disclosure have found that the properties of the lubricating base oil of the present disclosure are affected by the following relationships. According to an embodiment of the present disclosure, the lubricating base oil may satisfy $0.3 \leq (C_N+C_A)/C_P \leq 0.7$. Here, $C_N$ is the wt % of the naphthenic hydrocarbon, $C_A$ is the wt % of the aromatic hydrocarbon, and $C_P$ is the wt % of the paraffinic hydrocarbon. If the value of $(C_N+C_A)/C_P$ is less than 0.3, it is difficult to achieve the desired low pour point of the lubricating base oil. On the other hand, if the value of $(C_N+C_A)/C_P$ exceeds 0.7, it is difficult to achieve the desired low-temperature viscosity of the lubricating base oil.

According to another embodiment of the present disclosure, the lubricating base oil may satisfy 25 wt $\% \leq C_N+C_A \leq 45$ wt %. Likewise, if the value of $(C_N+C_A)$ is less than 25 wt %, it is difficult to achieve the desired low pour point of the lubricating base oil. On the other hand, if the value of $(C_N+C_A)$ exceeds 45 wt %, it is difficult to achieve the desired low-temperature viscosity of the lubricating base oil.

According to an embodiment of the present disclosure, the lubricating base oil may have low-temperature viscosity of 550 cSt or less, preferably 520 cSt or less, and more preferably 500 cSt or less when measured at −40° C. If the kinematic viscosity of the lubricating base oil exceeds 550 cSt at −40° C., the kinematic viscosity is so high that it is difficult to function as a lubricating base oil in very cold environments.

According to an embodiment of the present disclosure, the lubricating base oil may have a flash point of 110° C. or more, evaporation loss at 150° C. of 20 wt % or less, and a 5% outflow temperature of 200° C. or more in a simulated distillation test according to ASTM D2887. Preferably, the lubricating base oil has a flash point of 120° C. or more, evaporation loss at 150° C. of 18 wt % or less, and a 5% outflow temperature of 220° C. or more in a simulated distillation test according to ASTM D2887. In order to serve in various fields, lubricants must have resistance to heat that may occur in various fields. For example, a lubricant having a specific flash point may ignite at a temperature higher than the flash point, and therefore cannot be applied as a lubricant in an environment in which temperatures higher than the flash point are required. Moreover, low evaporation of the lubricating base oil reduces the consumption of oil and increases the durability of oil, and is thus regarded as important in the production of a low-viscosity lubricant. If the 5% outflow temperature in a simulated distillation test is lower than 200° C., a problem in which the flash point and evaporation loss of the lubricating base oil are not satisfied may occur. In the present disclosure, the flash point of the lubricating base oil is measured through the ASTM D92-COC method. Also, evaporation loss is measured at a temperature of 150° C., rather than 250° C., in the ASTM D5800 test.

Lubricant Product

An embodiment of the present disclosure provides a lubricant product including a mineral lubricating base oil having improved low-temperature performance. As the lubricating base oil having improved low-temperature performance, the aforementioned lubricating base oil is used.

In an embodiment of the present disclosure, the lubricant product may include 20 to 99 wt % of the lubricating base oil according to the present disclosure. The amount of the lubricating base oil according to the present disclosure may be variously adjusted depending on the end use and purpose of the lubricant product, and the lubricating base oil according to the present disclosure may be used in appropriate combinations with other mineral lubricating base oil products so as to be adapted for desired product specifications.

The lubricant product may have a pour point of −40° C. or less, preferably −45° C. or less, and more preferably −50° C. or less.

In an embodiment of the present disclosure, the lubricant product does not contain synthetic base oil. For example, the lubricant product does not contain PAO or ester base oil. The use of the lubricating base oil according to the present disclosure, rather than expensive PAO or ester base oil, makes it possible to manufacture lubricant products having superior low-temperature performance.

In an embodiment of the present disclosure, the lubricant product may further include an additive. The additive may be, for example, an antioxidant, a rust inhibitor, a clean dispersant, an antifoaming agent, a viscosity improver, a viscosity index improver, an extreme pressure agent, a pour point depressant, a corrosion inhibitor, or an emulsifier. However, the additive is not limited thereto, so long as it is one that is generally added to lubricant products.

The lubricant product may be used in fields or environments in which low-temperature performance is required, and it is possible to replace conventional lubricant products manufactured from PAOs or ester base oils. The lubricant product may be, for example, shock absorber oil for automobiles, hydraulic oil for use in polar regions, electrical insulating oil, etc., but is not limited thereto.

In addition, in an embodiment according to the present disclosure, the lubricant product is applicable as white oil for use in the lubrication of plastics, polishes, the paper industry, textile lubricants, pesticide base oils, pharmaceutical compositions, cosmetics, food and food-processing machinery, etc.

A better understanding of the present disclosure may be obtained through the following examples, which are merely set forth to illustrate the present disclosure and are not to be construed as limiting the scope of the present disclosure.

EXAMPLES

1. Production of Lubricating Base Oil (YUBASE 1)

t-LGO was obtained by subjecting the product of a fuel-oil hydrogenation process using vacuum gas oil (VGO) to fractional distillation. The properties of the t-LGO thus obtained are shown in Table 2 below, and the numerical values of the properties were measured according to ASTM methods.

TABLE 2

| Items | Method | Data |
|---|---|---|
| API Gravity | D1298 | 36.5 |
| Specific grayity (60/60° F.) | D1298 | 0.8423 |
| Kinematic viscosity @40° C., cSt | D445 | 4.494 |
| Kinematic viscosity @100° C., cSt | D445 | 1.58 |
| Pour point, ° C. | D97 | −15 |
| Sulfur content, ppm | D5453 | 1.3 |
| Nitrogen content, ppm | D4629 | 1.0 |

The t-LGO obtained above was fed to a catalytic dewaxing (CDW) unit, and the product of the catalytic dewaxing was fed to a hydrofinishing (HDF) unit. The processing conditions of the catalytic dewaxing unit and the processing conditions of the hydrofinishing unit are shown in Table 3 below. Thereafter, the product of the hydrofinishing unit was recovered as lubricating base oil.

TABLE 3

| | | Catalyst | |
|---|---|---|---|
| | | CDW | Pt-based catalyst |
| | | HDF | Pt-based catalyst |
| LHSV | $hr^{-1}$ | | 1.4 |
| $H_2$/Oil ratio | $Nm^3/Sm^3$ | | 500 |
| $H_2$ flow rate | NL/hr | | 280 |
| Feed speed | cc/hr | | 560 |
| Pressure | $Kg/cm^2g$ | | 150 |
| Reaction temperature (CDW/HDF) | ° C. | | 330/230 |

2. Analysis of Properties and Composition of Produced Lubricating Base Oil

The composition and properties of the lubricating base oil produced as described above were analyzed. The composition and properties thereof are shown in the following Tables 4 and 5, respectively.

TABLE 4

| | |
|---|---|
| Paraffinic hydrocarbon content ($C_P$), wt % | 61.6 |
| Naphthenic hydrocarbon content ($C_N$), wt % | 37.5 |
| Aromatic hydrocarbon content ($C_A$), wt % | 0.9 |
| $(C_N + C_A)/C_P$ | 0.59 |
| $C_N + C_A$ | 38.4 |

The amount of each type of hydrocarbon in the lubricating base oil was measured according to the ASTM D2140 test method. As shown in Table 4, YUBASE 1 satisfied $(C_N+C_A)/C_P$ in the range of 0.3 to 0.7 and $C_N+C_A$ in the range of 25 wt % to 45 wt %.

TABLE 5

| Items | YUBASE 1 |
|---|---|
| Kinematic viscosity @40° C., cSt | 4.934 |
| Kinematic viscosity' @100° C., cSt | 1.662 |
| D5%, D2887, ° C. | 222 |
| Flash point, ° C. | 130 |
| Evaporation loss (@150° C., wt %) | 17.4 |
| Pour point, ° C. | −69 |

As shown in Table 5, the lubricating base oil of the present disclosure was mineral lubricating base oil, rather than synthetic base oil, but exhibited low kinematic viscosity and superior low-temperature performance even without the use of an additional additive.

Conventionally, as described above, PAO is mainly used as a lubricating base oil in fields requiring low-temperature performance. Accordingly, making it possible to use the lubricating base oil of the present disclosure in lieu of PAO is an important purpose of the present disclosure. The properties of the lubricating base oil (YUBASE 1, hereinafter referred to as "YU-1") according to the present disclosure and the properties of PAO are compared in Table 6 below.

TABLE 6

| Items | PAO | YU-1 |
|---|---|---|
| Specific gravity (15/4° C.) | 0.7982 | 0.8383 |
| Kinematic viscosity @40° C., cSt | 5.111 | 4.934 |
| Kinematic viscosity @100° C., cSt | 1.709 | 1.662 |
| Pour point, ° C. | Less than −50 | Less than −50 |
| Aniline point, ° C. | 102.3 | 88.4 |
| Naphthenic hydrocarbon, wt % | <1 | 38 |

As shown in Table 6, the lubricating base oil (YU-1) of the present disclosure exhibited kinematic viscosity and a pour point superior or similar to those of PAO.

3. Confirmation of Performance of Lubricant Product

In order to confirm the low-temperature performance of the lubricating base oil according to the present disclosure when used in the manufacture of a lubricant product, a lubricant product including the lubricating base oil (YU-1) having the composition of Table 4 and the properties of Table 5 was manufactured, and the performance thereof was confirmed.

(1) Shock Absorber Oil for Automobiles

A lubricant product for use in shock absorbers for automobiles was manufactured using YU-1. The composition of the product is shown in Table 7 below.

TABLE 7

| Composition | Amount (wt %) |
|---|---|
| YU-1 (Base oil) | 90.0 |
| Viscosity index improver (VII) | 8.7 |
| Friction modifier (FM) | 1.0 |
| Antioxidant (AO) | 0.3 |
| Total | 100.0 |

Also, the properties of the shock absorber oil are shown in Table 8 below.

TABLE 8

| Test items | YU-1-based shock absorber oil |
|---|---|
| Kinematic viscosity, cSt (@40° C.) | 11.75 |
| Kinematic viscosity, cSt (@100° C.) | 4.451 |
| Viscosity index | 364 |
| Brookfield viscosity, cP (@−40° C.) | 498 |
| Pour point, ° C. | Less than −50 |
| Evaporation loss, wt % (ASTM D5800 @150° C.) | 15.2 |

As shown in Table 8, it can be confirmed that the use of the YU-1 lubricating base oil according to the present disclosure makes it possible to manufacture a shock absorber oil having superior performance without using PAO.

(2) Hydraulic Oil ISO VG 32 for Use in Polar Regions

Hydraulic oil for use in polar regions, corresponding to ISO VG 32, was manufactured by mixing YU-1 and Group III base oil, that is, YU-L3, available from SK Lubricants. The properties of YU-L3 are shown in Table 9 below.

TABLE 9

| Items | ASTM Method | Data |
|---|---|---|
| Specific gravity (@15/4° C.) | D1298 | 0.8324 |
| Kinematic viscosity, cSt (@40° C.) | D445 | 12.73 |
| Kinematic viscosity, cSt (@100° C.) | D445 | 3.12 |

TABLE 9-continued

| Items | ASTM Method | Data |
|---|---|---|
| Viscosity index | D2270 | 105 |
| Pour point, ° C. | D97 | −45 |

Also, the composition of the hydraulic oil for use in polar regions is shown in Table 10 below.

TABLE 10

| Composition | Amount (wt %) |
|---|---|
| YU-L3 (Base oil 1) | 37.78 |
| YU-1 (Base oil 2) | 43.00 |
| Viscosity index improver (VII) | 18.00 |
| Pour point depressant (PPD) | 0.30 |
| Antifoaming agent (AF) | 0.05 |
| Ashless antiwear agent(AW) | 0.87 |
| Total | 100.0 |

Also, the properties of the hydraulic oil for use in polar regions are shown in Table 11 below.

TABLE 11

| Test items | YU-1-based hydraulic oil |
|---|---|
| Kinematic viscosity, cSt (@40° C.) | 30.24 |
| Kinematic viscosity, cSt (@100° C.) | 9.825 |
| Viscosity index | 337 |
| Brookfield viscosity, cP (@−40° C.) | 2130 |
| Pour point, ° C. | −63 |

As shown in Table 11, the hydraulic oil composed of YU-1 and YU-L3 had low Brookfield viscosity at −40° C. and also a low pour point, and is thus regarded as a product having superior low-temperature performance. Thereby, it can be found that it is possible to design a mineral lubricant product having superior low-temperature performance without using PAO.

(3) Hydraulic Oil ISO VG 15 for Use in Polar Regions

Hydraulic oil for use in polar regions, corresponding to ISO VG 15, was manufactured using YU-1. The composition of the hydraulic oil for use in polar regions is shown in Table 12 below.

TABLE 12

| Composition | Amount (wt %) |
|---|---|
| YU-1 (Base oil) | 86 |
| Viscosity index improver | 13 |
| Other additives | 1 |
| Total | 100 |

Also, the properties of the hydraulic oil for use in polar regions are shown in Table 13 below.

TABLE 13

| Test items | YU-1-based hydraulic oil |
|---|---|
| Kinematic viscosity, cSt (@40° C.) | 14.21 |
| Kinematic viscosity, cSt (@100° C.) | 5.321 |
| Viscosity index | 381 |
| Brookfield viscosity, cP (@−40° C.) | <500 |
| Pour point, ° C. | −72 |

As shown in Table 13, the hydraulic oil manufactured using YU-1 had low Brookfield viscosity at −40° C. and also a low pour point, and is thus regarded as a product having superior low-temperature performance.

(4) Electrical Insulating Oil

Electrical insulating oil was manufactured by mixing YU-1 and Group III base oil, that is, YU-3, available from SK Lubricants. The properties of YU-3 are shown in Table 14 below.

TABLE 14

| Items | ASTM Method | Data |
|---|---|---|
| Specific gravity (@15/4° C.) | D1298 | 0.8299 |
| Kinematic viscosity, cSt (@40° C.) | D445 | 12.43 |
| Kinematic viscosity, cSt (@100° C.) | D445 | 3.12 |
| Viscosity index | D2270 | 112 |
| Pour point, ° C. | D97 | −24 |

The properties of the electrical insulating oil were tested by varying the amounts of the above two types of base oil. The test results are summarized in Table 15 below.

TABLE 15

| Composition | Specification | | Test results | | |
|---|---|---|---|---|---|
| YU-1 (Base oil 1) | ASTM | IEC | 20 | 25 | 30 |
| YU-3 (Base oil 2) | D3487 | 60296 | 80 | 75 | 70 |
| Kinematic viscosity, cSt (@40° C.) | ≤12.0 | ≤12.0 | 9.89 | 9.45 | 9.034 |
| Pour point, ° C. | ≤−40 | ≤−40 | −42 | −42 | −45 |
| Flash point (COC), ° C. | ≥145 | | 170 | 158 | 152 |
| Flash point (PMCC), ° C. | | ≥135 | 150 | 142 | 138 |

As shown in Table 15, as the amount of YU-1 increased, the flash point decreased, but the viscosity and the pour point further improved. Based on the above results, it can be found that it is possible to design electrical insulating oil that satisfies international standard requirements by appropriately mixing YU-1 with another mineral lubricating base oil.

(5) Applicability to White Oil

Whether YU-1 is usable as food-grade white oil was confirmed through experiments.

1) Measurement of UV Absorbance

Figure 2:
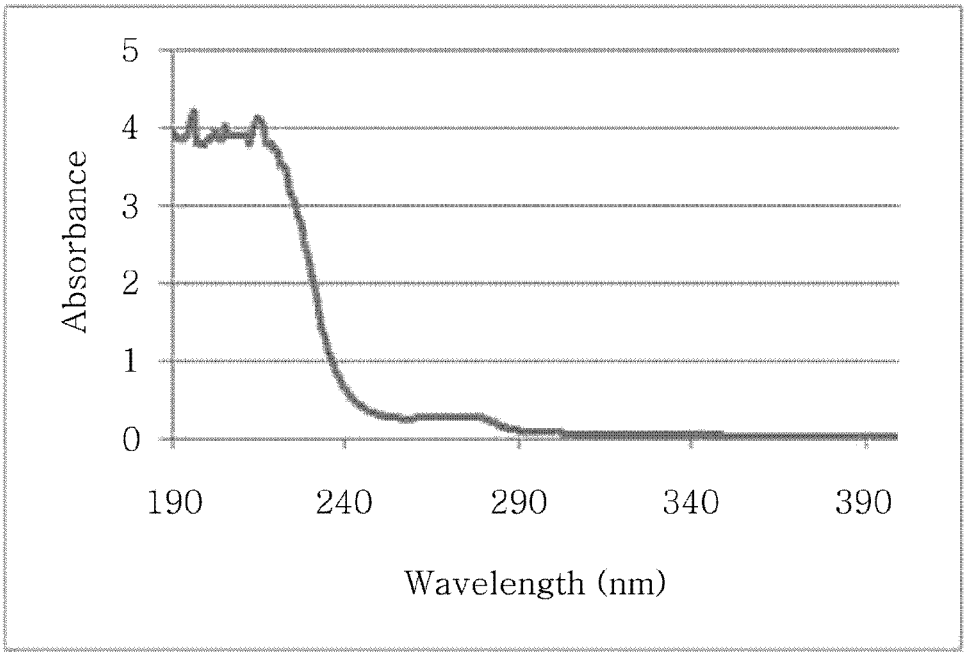
FIG. 2 is a plot of the results of measurement of UV absorbance of the lubricating base oil according to an embodiment.

In order to confirm that YU-1 satisfies the criteria for food-grade white oil prescribed by the US Food and Drug Administration (FDA), UV absorbance was measured in a wavelength range of 260-350 nm by directly radiating light onto YU-1. The results of measurement thereof are shown in FIG. 2.

Based on the experimental results, the UV absorbance of YU-1 in the above wavelength range was determined to be less than 0.1. The maximum UV absorbance of food-grade white oil prescribed by the US Food and Drug Administration (FDA) is 0.1, which indicates the value of UV absorbance determined through the DMSO extraction method according to the IP 346 method. The UV absorbance value determined through DMSO extraction is generally known to be lower than the absorbance value measured by directly radiating light onto a sample. Thus, with regard to YU-1 of the present disclosure, since the absorbance value measured by directly radiating light thereon is 0.1 or less, it is obvious that a lower absorbance value will be observed when measuring UV absorbance through the DMSO extraction method. Therefore, it can be found that YU-1 of the present disclosure satisfies food-grade requirements.

2) Sulfuric Acid Coloration Test

In order to confirm whether the amount of impurities contained in YU-1 falls within a range permitting use as white oil, a qualitative experiment was conducted using sulfuric acid. A sulfuric acid coloration test was performed according to the test method specified in ASTM D565. The results of the sulfuric acid coloration test are shown in FIG. 3.

Figure 3:
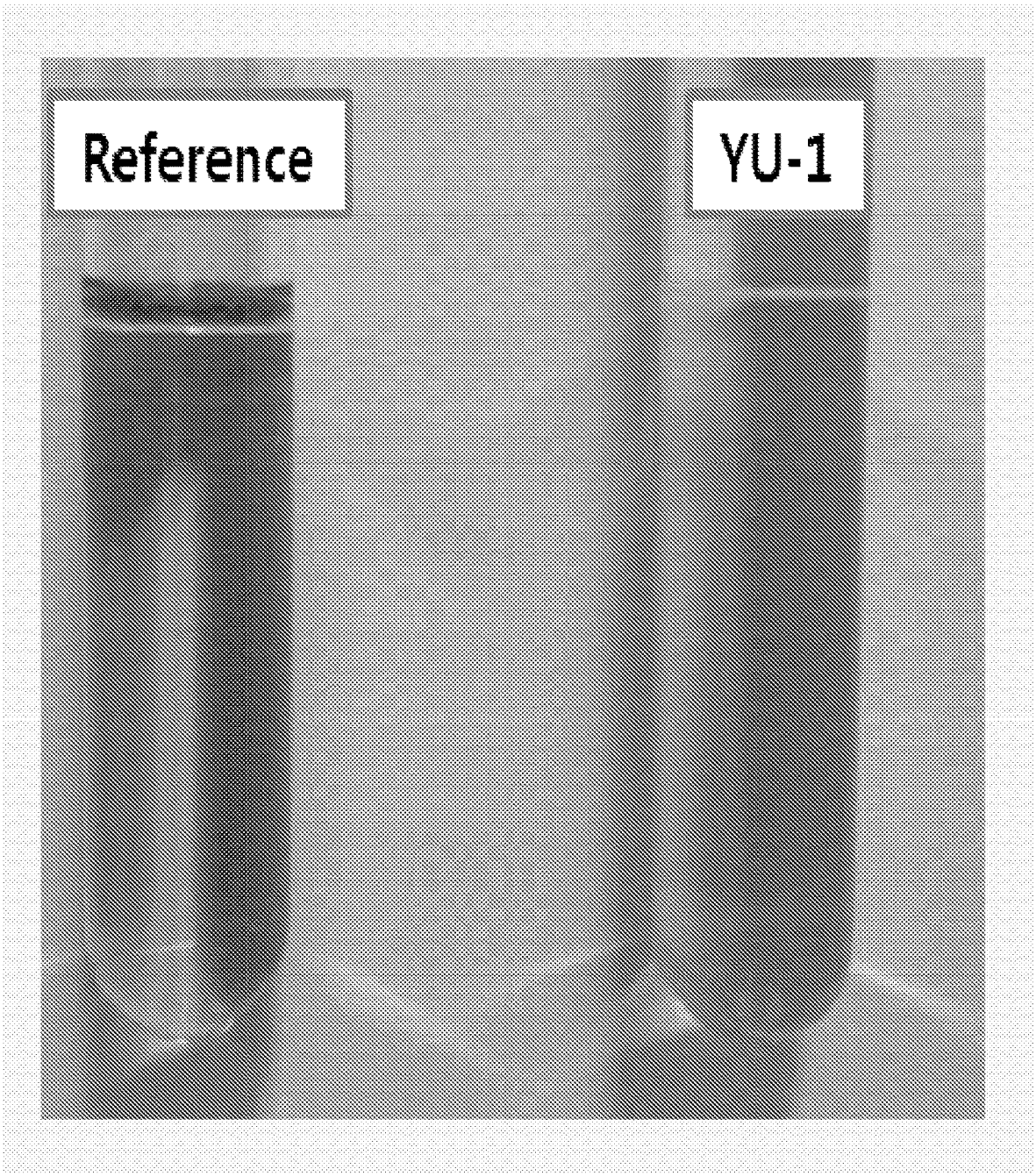
FIG. 3 shows the results of a sulfuric acid coloration test of the lubricating base oil according to an embodiment.

As shown in FIG. 3, the extent of discoloration of YU-1 was confirmed to be less than that of the reference. Therefore, it can be found that the amount of impurities in YU-1 falls within a range within which the use thereof as white oil is permitted.

Through the measurement of UV absorbance and the sulfuric acid coloration test, it can be concluded that YU-1 can be used as food-grade white oil.

Simple modifications or variations of the present disclosure fall within the scope of the present disclosure as defined in the accompanying claims.

The invention claimed is:

1. A mineral lubricating base oil having improved low-temperature performance, wherein the lubricating base oil has a kinematic viscosity of 9.0 cSt or less (at 40° C.), a kinematic viscosity of 2.5 cSt or less (at 100° C.), and a pour point of less than −50° C. wherein the lubricating base oil comprises 20 to 50 wt % of a naphthenic hydrocarbon.

2. The mineral lubricating base oil of claim 1, wherein the lubricating base oil is derived from a feedstock comprising a treated liquid gas oil resulting from hydrocracking, and the treated liquid gas oil has a 10 % outflow temperature of 250° C. or less and a 50% outflow temperature of 350° C. or less in a simulated distillation test according to ASTM D2887.

3. The mineral lubricating base oil of claim 2, wherein the treated liquid gas oil has a specific gravity of 0.81 to 0.87, a kinematic viscosity of 5.0 cSt or less (at 40° C.), a kinematic viscosity of 2.0 cSt or less (at 100° C.), and a pour point of 5° C. or less, and contains 2.0 wt % or less of each of sulfur and nitrogen.

4. The mineral lubricating base oil of claim 2, wherein the feedstock comprises 90 wt % or more of the treated liquid gas oil.

5. The mineral lubricating base oil of claim 1, wherein an average carbon number of a hydrocarbon molecule in the lubricating base oil is 14 to 25.

6. The mineral lubricating base oil of claim 1, wherein an amount of a hydrocarbon having 13 or fewer carbon atoms in the lubricating base oil is 25 wt % or less based on a total weight of the lubricating base oil.

7. The mineral lubricating base oil of claim 1, wherein the lubricating base oil satisfies $0.3 \leq (C_N+C_A)/C_A \leq 0.7$, in which $C_N$ is wt % of a naphthenic hydrocarbon, $C_A$ is wt % of an aromatic hydrocarbon, and $C_P$ is wt % of a paraffinic hydrocarbon.

8. The mineral lubricating base oil of claim 1, wherein the lubricating base oil satisfies 25 wt % $< C_N+C_A <$ 45 wt %, in which $C_N$ is wt % of a naphthenic hydrocarbon, and $C_A$ is wt % of an aromatic hydrocarbon.

9. The mineral lubricating base oil of claim 1, wherein the lubricating base oil has a kinematic viscosity of 500 cSt or less (at −40° C.).

10. The mineral lubricating base oil of claim 1, wherein the lubricating base oil has a flash point of 110° C. or more, evaporation loss at 150° C. of 20 wt % or less, and a 5% outflow temperature of 200° C. or more in a simulated distillation test according to ASTM D2887.

11. A lubricant product comprising 20 to 99 wt % of the lubricating base oil of claim 1 and having a pour point of −40° C. or less.

12. The lubricant product of claim 11, wherein the lubricant product does not comprise synthetic base oil.

13. The lubricant product of claim 11, wherein the lubricant product does not comprise polyalphaolefin (PAO) or ester base oil.

* * * * *